United States Patent [19]

Takeuchi et al.

[11] Patent Number: 4,873,530

[45] Date of Patent: Oct. 10, 1989

[54] ANTENNA DEVICE IN AUTOMOTIVE KEYLESS ENTRY SYSTEM

[75] Inventors: Mikio Takeuchi; Kinichiro Nakano, both of Zama; Kenichi Mitamura, Fujisawa; Takahisa Tomoda, Sagamihara, all of Japan

[73] Assignee: Nissan Motor Co., Ltd., Yokahama, Japan

[21] Appl. No.: 912,518

[22] Filed: Sep. 29, 1986

[30] Foreign Application Priority Data

Sep. 30, 1985 [JP] Japan ..... 60-214866

[51] Int. Cl.[4] ..... H01Q 1/32

[52] U.S. Cl. ..... 343/711; 343/712; 343/713

[58] Field of Search ..... 343/711, 712, 713; 340/825.31, 825.32

[56] References Cited

U.S. PATENT DOCUMENTS

| | | | |
|---|---|---|---|
| 3,587,051 | 6/1971 | Hovey | 340/164 |
| 3,593,816 | 7/1971 | Kazaoka | 180/113 |
| 3,633,167 | 1/1972 | Hedin | 340/164 |
| 3,641,396 | 2/1972 | Kossen et al. | 317/134 |
| 3,656,098 | 4/1972 | Duren et al. | 340/52 |
| 3,670,275 | 6/1972 | Kalliomaki et al. | 325/370 |
| 3,697,943 | 10/1972 | Andres | 340/52 |
| 3,710,316 | 1/1973 | Kromer | 340/63 |
| 3,723,967 | 3/1973 | Atkins et al. | 340/63 |
| 3,751,718 | 8/1973 | Hanchett, Jr. | 317/134 |
| 3,754,164 | 8/1973 | Zorzy | 317/134 |
| 3,754,213 | 8/1973 | Morroni et al. | 340/147 |
| 3,764,859 | 10/1973 | Wood et al. | 317/134 |
| 3,781,854 | 12/1973 | Kaufman et al. | 340/64 |
| 3,812,403 | 5/1974 | Gartner | 317/134 |
| 3,830,332 | 8/1974 | Fontaine | 180/113 |
| 3,831,065 | 8/1974 | Martin et al. | 317/134 |
| 3,859,624 | 1/1975 | Kirofsky et al. | 340/38 |
| 3,866,168 | 2/1975 | McGuirk, Jr. | 340/64 |
| 3,871,474 | 3/1975 | Tomlinson et al. | 180/112 |
| 3,878,511 | 4/1975 | Wagner | 340/147 |
| 3,885,408 | 5/1975 | Clark, Jr. | 70/278 |
| 3,891,980 | 6/1975 | Lewis et al. | 340/258 |
| 3,953,769 | 4/1976 | Sopko | 317/134 |
| 4,004,273 | 1/1977 | Kalogerson | 340/64 |
| 4,100,534 | 7/1978 | Shifflet, Jr. | 340/149 |
| 4,114,147 | 9/1978 | Hile | 340/528 |
| 4,129,855 | 12/1978 | Rodrian | 340/152 |
| 4,137,985 | 2/1979 | Winchell | 180/114 |
| 4,142,097 | 2/1979 | Ulch | 235/382 |
| 4,143,368 | 3/1979 | Route et al. | 340/543 |
| 4,148,092 | 4/1979 | Martin | 361/172 |
| 4,160,240 | 7/1979 | Partipilo | 340/311 |
| 4,189,712 | 2/1980 | Lemelson | 340/149 |
| 4,196,347 | 4/1980 | Hadley | 455/603 |
| 4,205,300 | 5/1980 | Ho et al. | 340/65 |
| 4,205,325 | 5/1980 | Haygood et al. | 340/147 |
| 4,206,491 | 6/1980 | Ligman et al. | 361/172 |
| 4,222,088 | 9/1980 | Burton | 361/172 |
| 4,223,296 | 9/1980 | Kim et al. | 340/52 |
| 4,232,354 | 11/1980 | Mueller et al. | 361/172 |
| 4,233,642 | 11/1980 | Ellsberg | 361/172 |
| 4,240,516 | 12/1980 | Henderson et al. | 180/289 |
| 4,249,161 | 2/1981 | Mohnhaupt | 340/52 |
| 4,249,245 | 2/1981 | Nakanishi et al. | 364/710 |
| 4,291,237 | 9/1981 | Kitano | 307/10 |
| 4,309,674 | 1/1982 | Owen | 332/18 |
| 4,317,157 | 2/1982 | Eckloff | 361/172 |

(List continued on next page.)

*Primary Examiner*—William L. Sikes
*Assistant Examiner*—Robert E. Wise
*Attorney, Agent, or Firm*—Foley & Lardner, Schwartz, Jeffery, Schwaab, Mack, Blumenthal & Evans

[57] ABSTRACT

In a ratio-mediated keyless entry system for an automotive vehicle, two vehicle-mounted antennae, lying in mutually perpendicular planes are used to receive radio signals from a portable, manually operable transmitter. When the transmitter is left in the passenger compartment and then the doors are locked, the system generates an alarm to notify the driver of the fact. On antenna completely encircles the passenger compartment. Encircling the passenger compartment with one of the vehicle-mounted antennae ensures that wherever the transmitter is left in the passenger compartment, its presence will be detected no matter how limited the transmitter's range.

15 Claims, 9 Drawing Sheets

U.S. PATENT DOCUMENTS

| | | | |
|---|---|---|---|
| 4,327,255 | 4/1982 | Suszylo | 179/90 |
| 4,332,305 | 6/1982 | Kocolowski | 180/271 |
| 4,354,189 | 10/1982 | Lemelson | 340/825.31 |
| 4,388,524 | 6/1983 | Walton | 235/380 |
| 4,418,416 | 11/1983 | Lese et al. | 375/5 |
| 4,447,808 | 5/1984 | Marcus | 340/696 |
| 4,450,431 | 5/1984 | Hochstein | 340/58 |
| 4,471,343 | 9/1984 | Lemelson | 340/571 |
| 4,473,825 | 9/1984 | Walton | 340/825.54 |
| 4,477,806 | 10/1984 | Mochida et al. | 340/825.32 |
| 4,479,255 | 10/1984 | Geesen et al. | 455/246 |
| 4,486,806 | 12/1984 | Mochida et al. | 361/172 |
| 4,509,093 | 4/1985 | Stellberger | 361/172 |
| 4,511,946 | 4/1985 | McGahan | 361/172 |
| 4,535,333 | 8/1985 | Twardowski | 340/825.69 |
| 4,550,444 | 10/1985 | Uebel | 455/41 |
| 4,554,542 | 11/1985 | Dolikian | 340/825.76 |
| 4,595,902 | 6/1986 | Proske et al. | 340/63 |
| 4,598,275 | 7/1986 | Ross et al. | 340/573 |
| 4,619,002 | 10/1986 | Thro | 455/226 |
| 4,630,044 | 12/1986 | Polzer | 340/825.72 |
| 4,670,746 | 6/1987 | Taniguchi et al. | 340/825.31 |
| 4,672,375 | 6/1987 | Mochida et al. | 340/825.31 |
| 4,688,036 | 8/1987 | Hirano et al. | 340/825.69 |
| 4,703,714 | 11/1987 | Bajka et al. | 118/57 |
| 4,719,460 | 1/1988 | Takeuchi et al. | 340/825.31 |

ANTENNA DEVICE IN AUTOMOTIVE KEYLESS ENTRY SYSTEM

BACKGROUND OF THE INVENTION

1. Field of the Invention

The present invention relates generally to an automotive keyless entry system which allows locking and unlocking of vehicular lock devices, such as door lock device, trunk lid lock device, steering lock device and so forth, utilizing a pocket-portable radio transmitter which transmits a radio signal containing a preset code. More specifically, the invention relates to an antenna device for radio signal communication between the pocket- portable transmitter and a controller mounted on a vehicle. In more detail, the invention relates to an antenna device which prevents the pocket-portable transmitter from being locked in the vehicle.

2. DESCRIPTION OF THE BACKGROUND ART

The copending U.S. patent application Ser. No. 651,783, filed on Sept. 18, 1984, by Motoki HIRANO and assigned to the common assignee to the present invention. discloses an automotive keyless entry system which prevents a radio code signal transmitter from being locked in the vehicle. In the disclosed system, a controller detects locking of a door lock device and repeatedly and cyclically transmits a demand signal to the transmitter for triggering the latter to transmit a radio code signal. An alarm is triggered if the radio code signal from the transmitter continues for a given first period of time. If the radio code signal from the transmitter continues for a given second period of time after the alarm, the keyless entry system is disabled. The first period of time is long enough for a user to move away from the vehicle out of radio signal transmission range. The second period of time is determined to be long enough to allow the user to unlock the door and remove the transmitter from the vehicle. Disabling of the keyless entry system ensures theft-prevention, since otherwise the door lock device could be easily unlocked by triggering the controller by depressing a push-button mounted on the outer surface of the vehicle.

In addition, the co-pending U.S. Pat. Application Ser. No. 651,784, now abandoned filed on Sept. 18, 1986, by Motoki HIRANO and assigned to the common assignee to the present invention, discloses an antenna device suitable for radio signal transmission between the transmitter and the controller by way of electromagnetic induction between antennas of the transmitter and the controller. The proposed antenna device is mounted on a vehicle and contains two loop antennas offset in phase by approximately 90° to ensure radio signal transmission to and from the antenna on a transmitter. Therefore, this prior proposed antenna device ensures radio signal transmission with a limited radio signal transmission range.

Limiting the radio transmission area prevents the transmitter and/or the controller from being unintentionally triggered due to noise in the atmosphere.

However, if the transmitter should be left within the vehicle but out of the radio transmission area, it would be impossible to notify the user that the transmitter is locked in the vehicle.

SUMMARY OF THE INVENTION

Therefore, it is an object of the present invention to provide an automotive keyless entry system which prevents a radio code transmitter from being locked in a vehicle.

Another object of the invention is to provide an automotive keyless entry system with an antenna device which expands the radio signal transmission area within the vehicle.

A further object of the invention is to provide an automotive keyless entry system with an antenna device which expands the radio, signal transmission area to cover the entire area in a vehicle compartment.

In order to accomplish the aforementioned and other objects, an automotive keyless entry system, according to the invention, includes a loop antenna device having a section surrounding the vehicle compartment.

Preferably, the antenna device comprises a first loop antenna surrounding the vehicle compartment and a second loop antenna disposed near a manually operable switch and lying in a plane perpendicular to the plane of the portion of the first loop antenna closest to the second antenna. Further preferable, the first loop antenna comprises a body harness and a main harness.

With this construction, since the first antenna surrounds the vehicle compartment, the radio signal transmission area covers all of the vehicle compartment space. Therefore, whenever the radio signal transmitter is left in the vehicle compartment, the presence of the radio signal transmitter can be detected and thus theft-prevention can be ensured.

DESCRIPTION OF THE PREFERRED EMBODIMENT

Figure 1:
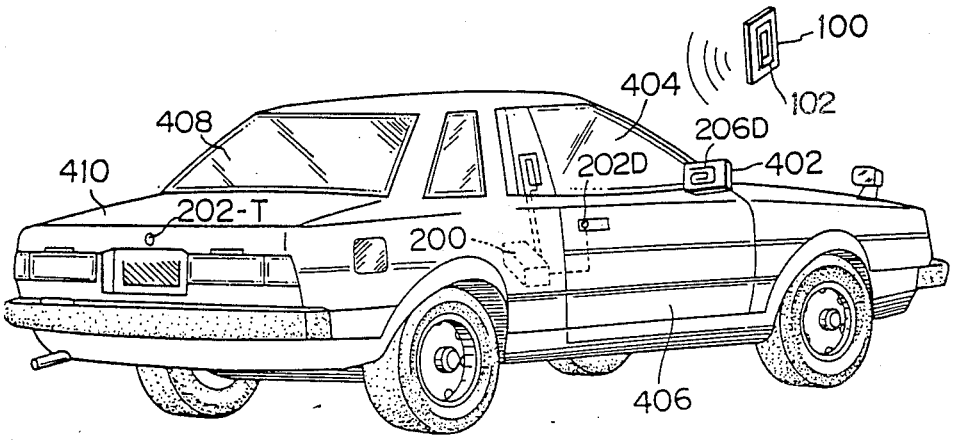
FIG. 1 is a perspective view of a vehicle to which a preferred embodiment of a keyless entry system in accordance with the present invention is applied.

Referring now to the drawings, the general concepts of the preferred embodiment of an automotive keyless entry system, according to the invention will be explained with reference to FIGS. 1 to 9.

Figure 2:
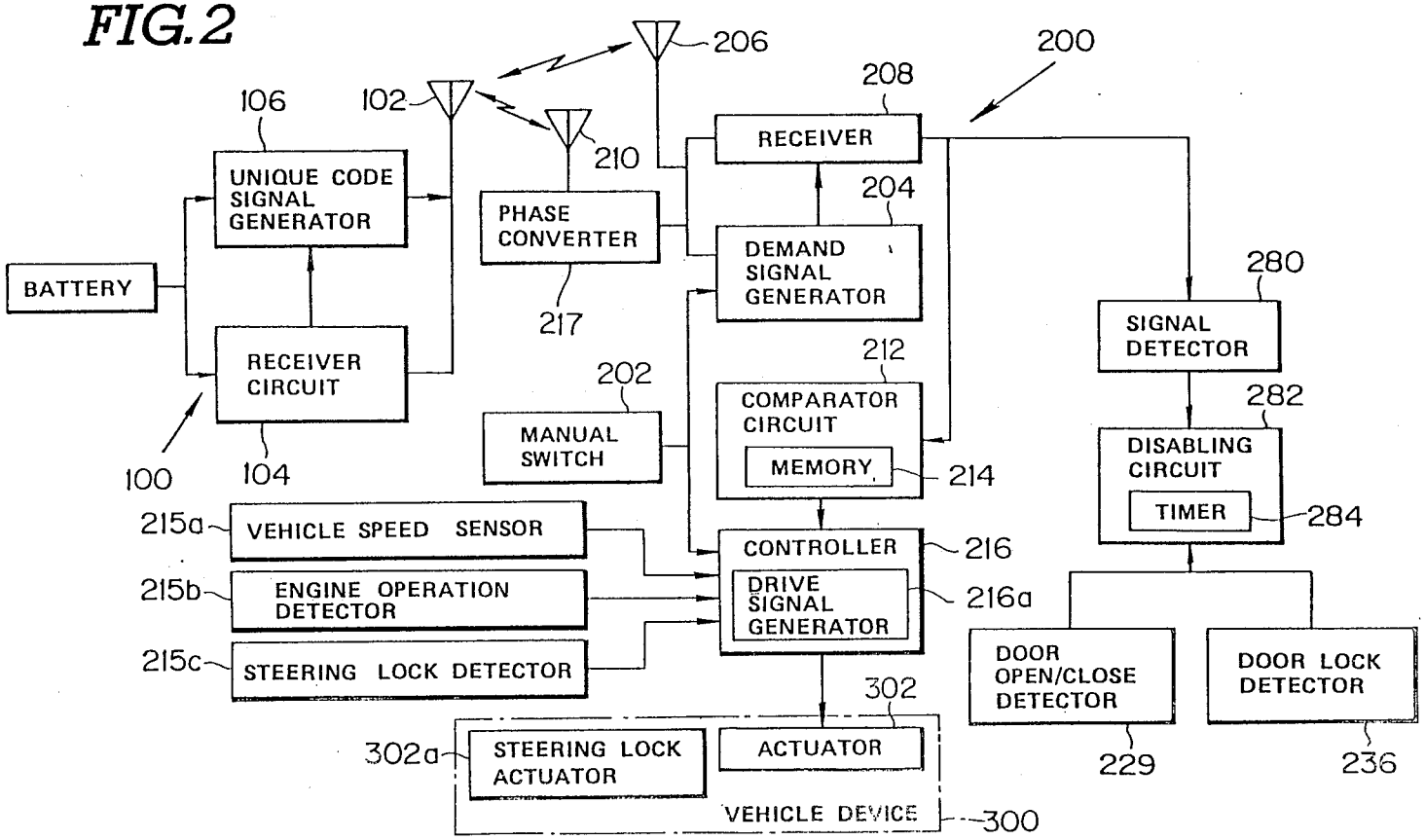
FIG. 2 is a block diagram of the general circuit arrangement of the preferred embodiment of the keyless entry system according to the invention.

Referring now to the drawings, FIGS. 1 and 2 show the general structure of the preferred embodiment of a keyless entry system according to the present invention. As shown in FIG. 1, the preferred embodiment of the keyless entry system of the present invention generally comprises a compact radio code signal transmitter 100 which is comparable in size with common bank or credit cards and so can be easily carried in a clothing pocket, and a controller 200 mounted on a vehicle. The controller 200 is connected with push-button-type manual switches 202 mounted on the outer surface of the vehicle body. The manual switches 202 are each located near the corresponding vehicle devices 300. In order to facilitate keyless operation, each of the vehicle devices is associated with corresponding actuator 302. In the shown embodiment, the keyless entry system is designed to operate a door lock and a trunk lid lock. Therefore, the manual switch 202-D for the door lock is mounted on the vehicle door 406. On the other hand, the manual switch 202-T for the trunk lid lock is mounted on the trunk lid 410 at an appropriate location near the trunk lid lock.

The shown embodiment of the keyless entry system is also designed to operate a steering locking mechanism. The steering locking mechanism includes a steering lock actuator 302*a*.

The radio code signal transmitter 100 has a thin, rectangular casing 101 on which a loop antenna 102 is provided. A loop antenna 206-D is mounted near enough the manual switch 202-D for the user to be able to depress the manual switch 202-D while holding the radio code signal transmitter 100 within broadcast range of the loop antenna 206-D.

The fundamental idea of the keyless entry system will be discussed with reference to FIG. 2. The manual switch 202 serves to request operation of the vehicle device 300. Furthermore, in accordance with the preferred embodiment of the keyless entry system of the invention, it is facilitated full-automatic door lock operation for allowing the user who is carrying the radio code signal transmitter 100 to lock and unlock the door lock. The controller 200 is responsive to depression of the manual switch 202 to produce the radio demand signal. A radio demand signal generator 204 in the controller produces the radio demand signal cyclically at regular intervals and temporarily in response to depression of the manual switch 202. The radio demand signal is transmitted by a transmitter antenna 206. The transmitter antenna 206 may be mounted on the external surface of the vehicle body near the vehicle device 300 to be operated. For example, if the vehicle device 300 to be operated were the left-front door lock, the radio code signal transmitter antenna 206 might then be mounted on the window pane of the left-front door or on a mirror mounted on the left-front door. In practice, the transmitter antenna 206 will be a loop-antenna printed on the chosen area of the vehicle or disposed in an appropriate space on the vehicle body.

It should be appreciated that, in practice, the preferred embodiment of the keyless entry system according to the present invention is designed to operate various vehicle devices including the door lock. Therefore, a plurality of manual switches are arranged near the respective vehicle devices to be operated. As set forth above, a plurality of antennas are provided near corresponding manual switches. In order to facilitate fully automatic operation of the door lock, the controller 200 is designed to transmit the radio demand signal repeatedly at regular intervals through the antenna corresponding to the door lock. On the other hand, to temporarily operate the door lock or to operate other vehicle devices, the corresponding manual switch must be depressed. In this case, the controller 200 is responsive to manual operation of the corresponding switches to transmit the radio demand signal through the antenna associated with the depressed manual switch.

The radio code signal transmitter 100 also has a transmitter/receiver antenna 102 which may be a loop-antenna printed on the outer surface of a radio code signal transmitter casing. The antenna 102 is connected to a receiver circuit 104 of the radio code signal transmitter 100 to receive the demand signal from the controller. The receiver circuit 104 is, in turn, connected to a unique signal generator 106 which generates a radio signal indicative of a unique combination of several digits in binary code. The radio signal produced by the unique signal generator 106 will be referred to hereafter as "unique code indicative radio code signal" or "radio code signal". The code indicated by the radio code signal is unique for each radio code signal transmitter 100 and serves to identify the radio code signal transmitter. The radio code signal of the radio code signal generator 106 is transmitted by the antenna 102.

A receiver 208 with a receiver antenna 210 is provided in the controller 200 to receive the radio code signal from the radio code signal transmitter 100. The receiver antenna 210 is also mounted on the external surface of the vehicle body near the transmitter antenna 206. The receiver 208 is connected to the radio demand signal generator 204 and responsive to the radio demand signal to be activated for a predetermined period of time. In other words, the receiver 208 is active for the predetermined period of time after the radio demand signal is transmitted. Signals received within the predetermined period of time are converted into binary code signals indicative of any and all digits encoded in the signal as they would be in the radio code signal transmitter 100. The receiver 208 sends the converted binary code signal to a Comparator circuit 212. The comparator circuit 212 includes a memory 214 storing a preset code which matches the unique code of the radio code signal transmitter 100. The comparator circuit 212 compares the binary-coded digits from the receiver 208 with the preset code and produces a HIGH-level comparator signal when the codes match. A controller 216 including a driver signal generator 216*a* is responsive to the HIGH-level comparator signal produced by the comparator circuit 212 to produce a driver signal for an actuator 302 in the vehicle device.

In the shown embodiment, the controller 216 is designed to detect vehicle conditions satisfying predetermined steering lock conditions. In the preferred embodiment, keyless steering lock operation is performed when the vehicle is at rest, the engine is not running and the unique code matches the preset code. In order to test these conditions, the controller 216 receives signals from a vehicle speed sensor 215*a* and an engine stop condition detector 215*b*. The vehicle speed sensor 215*a* produces a vehicle speed indicative signal. On the other hand, the engine operation detector detects when the engine is not running and produces an engine-off signal. The controller 216 is also connected to a steering lock detector 215*c* which produces a steering locking condition indicative signal.

In cases where the keyless entry system is designed to operate more than one vehicle device, the controller 216 is also connected to the manual switches 202 so as to be able to operate the corresponding vehicle devices. The controller 216 recognizes which of the manual switches 202 is operated and sends a driver signal to the actuator of the corresponding vehicle device.

In the aforementioned arrangement, the radio code signal transmitter 100 uses a small, long-life battery 108 as a power source. In practice, a mercury battery or its equivalent could be used in the radio code signal transmitter. On the other hand, the controller 216 uses a vehicle battery 218 as a power source. The aforementioned keyless entry system according to the present invention achieves conservation of battery power by being operative only when the manual switch is operated. It would be convenient to provide a weak battery alarm in the system. A suitable weak battery-alarm feature for a keyless entry system has been disclosed in the co-pending U.S. Pat. Application Ser. No. 651,783 now U.S. Pat. No 4,737,784 filed on Sept. 18, 1984, commonly assigned to the assignee of the present invention. The disclosure of this co-pending U.S. Patent Application is hereby incorporated by reference for the sake of disclosure.

The receiver 208 is also connected to a signal detector 280 which detects reception of the radio code signal from the radio code signal transmitter 100. The signal detector 280 sends a detector signal to a disabling circuit 282 as long as the presence of the unique code signal is detected. The disabling circuit 282 is also connected to a door closure detector 229 and a door lock detecting switch 236. The disabling circuit 282 incorporates a timer 284 for measuring elapsed time from operation or depression of the one of the manual o switches 202-D or 202-T. The disabling circuit 282 responds to the presence of the detector signal after a predetermined period of time, given that all of the doors are closed and locked as indicated by the door closure detector and the door lock detecting switch, to produce a disabling signal. The disabling signal disables production of the driver signal by the driver generator 216. On the other hand, while the driver signal generator 216 is disabled, the disabling circuit 282 is responsive to opening of one of the doors to stop the disabling signal and resume keyless entry operation.

In summary, the radio code signal transmitter is recognized to be locked in the vehicle when all of the doors are closed and locked and the unique code signal from the radio code signal transmitter is received continuously for a period longer than a preset period of time. The preset period of time is determined empirically such that the period is long enough for the user to move out of transmission range but short enough that the user will still be able to hear the alarm indicating that the radio code signal transmitter is about to be left in the vehicle. In order to enable the user to unlock the door in order to remove the radio code signal transmitter from the vehicle, the system remains operative for a few minutes, which should be long enough for the user to return to the vehicle and to operate the manual switch for the door lock. If the user fails to notice the alarm and therefore does not operate the keyless entry system to unlock the door and remove the radio code signal transmitter from the vehicle, the keyless entry system is rendered inoperative after those few minutes to inhibit keyless entry operation until the door is unlocked by means of a mechanical key.

This satisfactorily and successfully prevents the vehicle from being stolen by simple operation of the manual switch while the radio code signal transmitter is in the vehicle.

The present invention will be described in more detail in terms of the preferred embodiment of the invention with reference to FIGS. 2 to 4.

Figure 3:
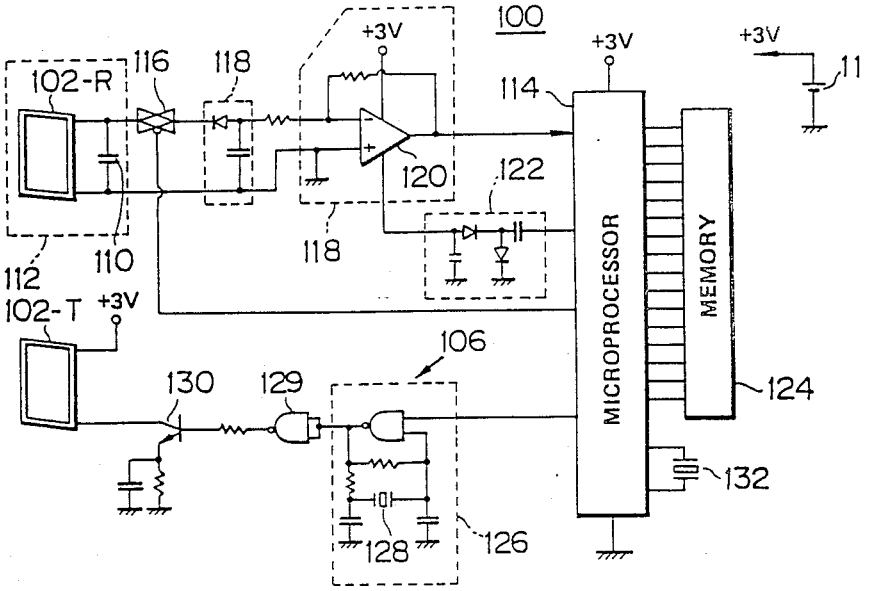
FIG. 3 is a schematic circuit diagram of a radio code signal transmitter in the preferred embodiment of keyless entry system of FIG. 2.

As shown in FIGS. 2 and 3, as in the controller 200, the radio code signal transmitter 100 is provided with a pair of loop antennas 102-R and 102-T which are printed on the outer surface of the radio code signal transmitter casing (not shown) or installed in the internal space of the radio code signal transmitter casing. The antenna 102-R is connected to the receiver circuit 104 and serves as a receiver antenna. On the other hand, the antenna 102-T is connected to the radio code signal generator 106 and serves as a radio code signal transmitter antenna. A capacitor 110 is connected in parallel with the receiver antenna 102-R to form a passive antenna circuit 112. The antenna circuit 112 captures by electromagnetic induction the radio demand signal from the controller 200 produced in response to depression of one of the manual switches 202.

The antenna circuit 112 is connected to a microprocessor 114 via an analog switch 116, a detector circuit 118 and an amplifier 120. A negative power supply circuit 122 is inserted between an outer terminal of the microprocessor 114 and the amplifier 120 to invert a 0 or +3V binary pulse output from the microprocessor into a 0 to −3V input to the amplifier. This negative power is supplied to the amplifier to adjust the bias point of the amplifier to 0 V.

The microprocessor 114 is connected to a memory 124 storing the preset unique code. In practice, the memory stores four predetermined, four-bit. BCD digits. The memory 124 can be a ROM pre-masked with the preset code. However, in order to minimize the cost, it would be advantageous to use a circuit in the form of a printed circuit board including circuit elements corresponding to each bit. When the circuit element is connected, it is indicative of "1" and when the circuit element is cut or disconnected, it is indicative of "0". By this arrangement, the preset code may be input simply to the microprocessor 114.

The microprocessor 114 is designed to be triggered by the radio demand signal from the controller 200, i.e., input to the microprocessor 114 through the antenna 102-R, the analog switch 116, the detector circuit 118 and the amplifier 120 serves as the trigger signal for the microprocessor. In response to the trigger signal, the microprocessor 114 reads the preset unique code from the memory 124 and sends a serial pulse-form radio code signal indicative of the unique code to a modulator 126. The modulator 126 includes a crystal oscillator 128 for generating a carrier wave for the unique code signal. In the modulator 126, the radio code signal and the carrier wave are modulated into a radio signal in which the radio code signal rides on the carrier wave. The modulated radio signal is output through a buffer 129, a high-frequency transistor 130 and a transmitter antenna 102-T.

Another crystal oscillator 132 is connected to the microprocessor 114. The oscillator 132 may serve as a clock generator feeding clock pulses to the microprocessor.

In the above arrangement of the radio code signal transmitter, electric power is supplied to the components by a small, long-life-type lithium cell 134 such as are used in electronic watches. The microcomputer to be used for the radio code signal transmitter 100 is of the low-voltage CMOS type. The analog switch 118 and the amplifier 120 IC units are also chosen to be of the power-saving type. As a result, stand-by operation requires only about 4 to 5 mA. This means that the radio code signal transmitter 100 can be used for about one year before replacing the lithium battery.

Figure 4:
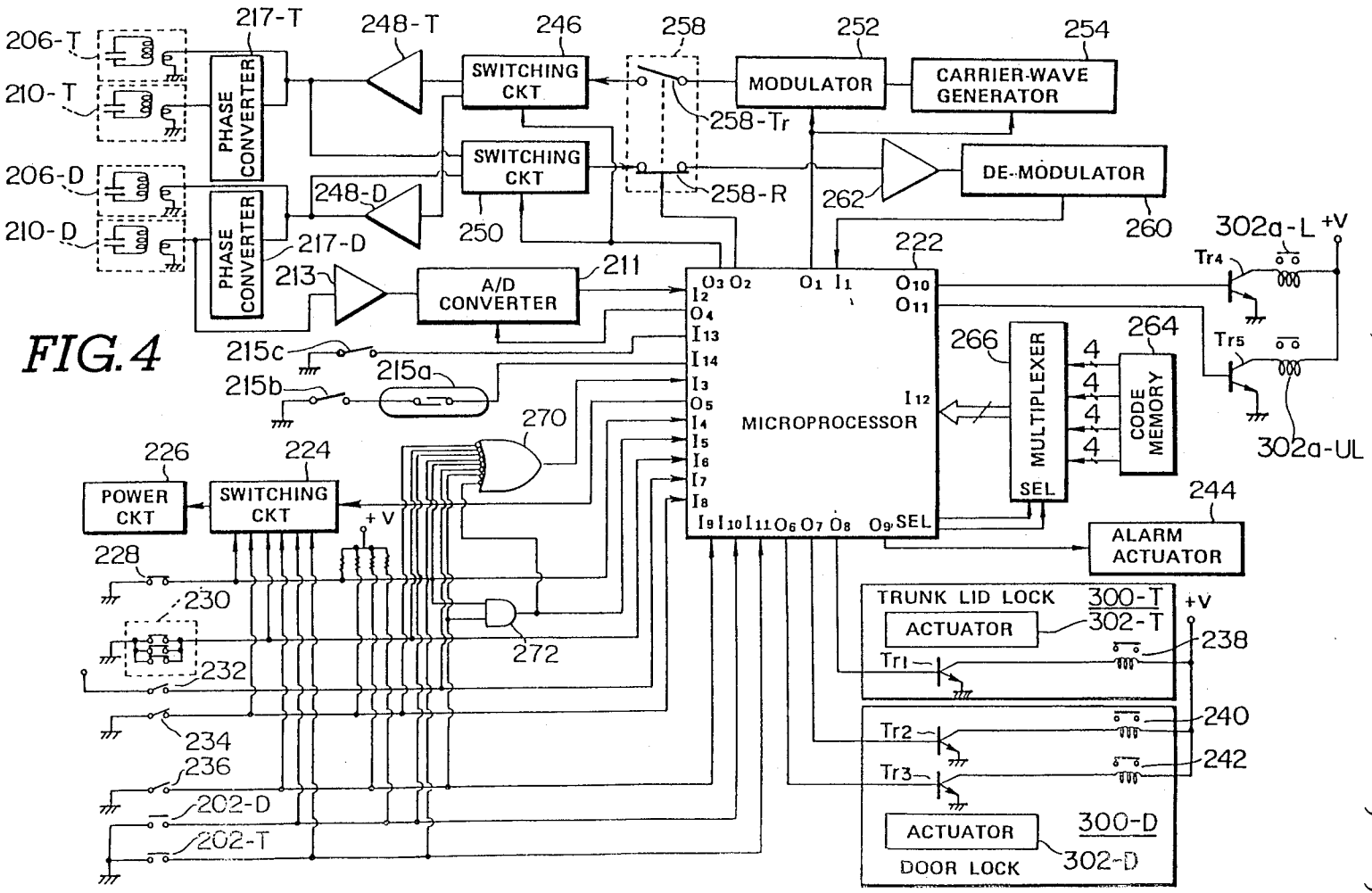
FIG. 4 is a schematic circuit diagram of a controller in the preferred embodiment of the keyless entry system of FIG. 2.
Figure 5:
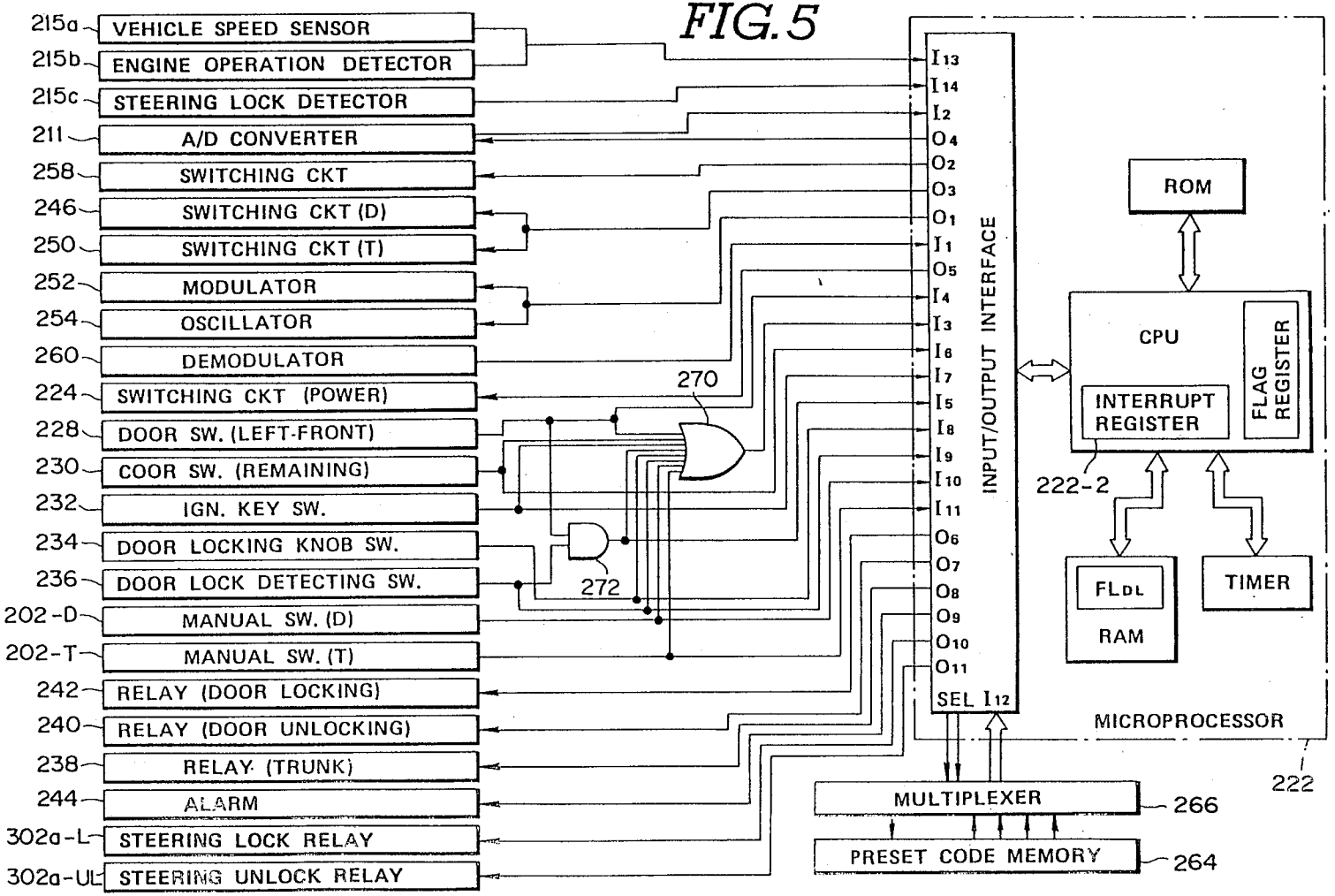
FIG. 5 is a block diagram showing details of a microprocessor in the controller of FIG. 4.

As shown in FIGS. 4 and 5, the controller 200 comprises a microprocessor 222 including an input/output interface, CPU, ROM, RAM, timer and so forth. In the shown embodiment, the microprocessor 222 is connected to manual switches 202-D and 202-T, which are respectively designed to operate the door lock and the trunk lid lock. However, it should be appreciated that the present invention is applicable for operating not only the door lock and trunk lid lock but also other vehicle devices, such as a steering lock, a glove-box lid lock and so forth. In the shown embodiment, the keyless entry system is designed to operate a door lock 300-D and a trunk-lid lock 300-T. Accordingly, the manual switch 202-D is connected to the controller 200 in order to operate the door lock 300-D and the manual switch 202-T is similarly operable when the trunk lid lock 300-T is to be operated. The manual switches 202-D and 202-T are connected to the input terminals $I_9$ and $I_{10}$ of the microprocessor 222. The manual switches 202-D and 202-T are also connected to a switching circuit 224 inserted between the output terminal $O_5$ of the microprocessor 222 and a power supply circuit 226.

The switching circuit 224 is also connected to a driver's door switch 228, passenger door switches 230, an ignition key switch 232, a door lock knob switch 234 and a door-lock-detecting switch 236. The driver's door switch 226 detects opening and closing of the left-front door adjacent the driver's seat and is closed while the left-front door is open. The passenger door switches 230, detects opening and closing of the right-front door and the rear doors. These stitches 230 close when the corresponding door opens. The door switches are built and operated as conventionally utilized for door closure monitoring. Alternatively, it would be simpler to connect the switching circuit 224 to conventional door switches.

The ignition key switch 232 is installed within or near an ignition key cylinder and detects the presence of an ignition key in the key cylinder. The ignition key switch 232 is closed while the ignition key is within the key cylinder.

The door lock knob switch 234 is responsive to a manual door locking operation by which the door lock of the driver's door is manually operated in the door-locking direction. The door lock knob switch 234 closes when the door lock knob is operated manually to perform door locking. The door lock detecting switch 236 detects the locking state of the door lock. Specifically the switch 236 is closed while any of the door locks are unlocked and is open when all of the door locks are in their locking positions.

The switching circuit 224 is responsive to closure of any one of the switches 202-D, 202-T, 228, 230, 232, 234 and 236 to trigger the power supply circuit 226 for a given period of time. The power supply circuit 226 is active for the given period of time to supply a vehicle battery power to the various components of the controller circuit. In addition, the switching circuit 224 is responsive to high-level output from the output terminal $O_5$ of the microprocessor 222 to be held active and thus sustain operation of the power supply circuit 226 as long as the high-level output continues. The switching circuit 224 deactivates the power supply circuit when the output level of the output terminal $O_5$ drops from high to low.

The microprocessor 222 has input terminals in its input/output interface to be connected to the driver's door switch 228, the passenger door switch 230, the ignition key switch 222, the door lock knob switch 234 and a door-lock-detecting switch 236. Also, the microprocessor 222 is connected to the steering lock detector **215*c*, the engine stop condition detector 215*b* and the vehicle speed detector 215*a***.

Output terminals $O_6$, $O_7$ and $O_9$ of the microprocessor 222 are respectively connected to actuator relays 238, 240 and 242 via switching transistors $Tr_1$ -$Tr_3$. The actuator relay 238 is associated with an actuator 302-T of the trunk lid lock 300-T. The actuator relays 240 and 242 are associated with an actuator 302-D of the door lock 300-D. In practice, the actuator 302-D comprises a reversible motor which actuates the door lock 3200-D to its locked position when driven in one direction and to its unlocked position when driven in the other direction. Two relays 240 and 242 are designed to reverse the polarity of power supply and thus switch the driving direction of the reversible motor. For instance, when the relay 240 is energized, the reversible motor 302-D S is driven in the door-unlocking direction. On the other hand, when the relay 242 is energized, the reversible motor 302-D is driven in the door-locking direction. Therefore, the output level at the output terminal $O_7$ goes high when the door is to be unlocked and the output terminal $O_8$ goes high when the door is to be locked.

In addition, the microprocessor 222 has another output terminal connected to a steering lock relay **302*a*-L and a steering unlock relay 302*a*-UL** through switching transistors Tr4 and Tr5.

The microprocessor 222 is programmed to execute a theft-preventive operation in response to a specific condition. For example, if the door switch is closed while the door lock detecting switch is open, a theft-preventive alarm signal is output via the output terminal $O_9$ which is connected to an alarm actuator 244. In practice, the alarm actuator 244 may be connected to a vehicular horn to activate the latter in response to the theft-preventive alarm signal. This theft preventive operation in keyless entry systems has been disclosed in the European Patent First Publication 00 73 068, published On Mar. 2, 1983. The disclosure of this European Patent First Publication is herein incorporated by reference for the sake of disclosure. On the other hand, the theft-preventive operation could be performed by the microprocessor by counting erroneous operations within a given period of time.

The antennas 206-D and 210-D in the shown embodiment are located near the door locks and the trunk lid locks. As an example, the antenna 206-D may be applied to or printed on the reflective surface of a door mirror 402, as shown in FIG. 1. The antenna 210-D may be applied to or printed on a window pane 404 of the vehicle side door 406. On the other hand, the antennas 06-T and 210-T are mounted near the trunk lid lock and may be applied to or printed on the rear windshield 408, as shown in FIG. 1.

As shown in FIG. 4, the antennas 206-D and 210-D are coupled to transmit the radio demand signal $S_{DM}$ and receive the radio code signal $S_{CM}$ when the door lock 300-D is to be operated. The antenna 210-D is connected to a phase converter 217-D which shifts the phase of the radio code signal received via the antenna 210-D through 90°.

The antenna 210-D is also connected to an analog-to-digital converter (A/D converter) 211 through a high-frequency amplifier 213. The A/D converter 211 outputs a digital signal $S_{Rf}$ indicative of the received signal level to the input terminal $I_2$ of the microprocessor 222. The A/D converter 211 is also connected to the output terminal $O_4$ of the microprocessor 222 and is gated by a trigger signal output through the output terminal $O_4$. Similarly, the antennas 206-T and 210-T are coupled to transmit the radio demand signal to the radio code signal transmitter 100 and receive the radio code signal in return when operation of the trunk lid lock is requested via the manual switch 202-T. The antenna 210-T is connected to phase converter 217-T which shifts the radio code signal phase received by the antenna 210-T through 90°.

The pairs of antennas 206-D, 210-D and 206-T, 210-T are connected for input from a switching circuit 246 through respectively corresponding high-frequency amplifiers 248-D and 248-T. The switching circuit 246 selectively activates one pair of antennas 206-D, 210-D or 206-T, 210-T to transmit the radio demand signal $S_{DM}$. For instance, when the manual switch 202-D is depressed to produce the radio demand signal SDM for operating the door lock 300-D, the antennas 206-D and 210-D become active to transmit the demand signal to the radio code signal transmitter. The signal phase of the radio demand signal transmitted through the antenna 210-D is shifted through 90° by means of the phase converter 217-D. On the other hand, when the manual switch 202-T is depressed, the switching circuit 246 selects the antennas 206-T and 210-T. Similarly to the above, the radio demand signal $S_{DM}$ is thus transmitted to the radio code signal transmitter 100 through the antennas 206-T and 210-T and the signal phase of the demand signal transmitted through the antenna 210-T is shifted through 90° by the phase converter 217-T.

The switching circuit 246 is connected for input from a modulator 252 via a switch terminal 258-Tr of a switching circuit 258. The modulator 252 is, in turn, connected for input from the output terminal $O_1$ of the microprocessor 222. Similarly, the switching circuit 250 is connected to demodulator 260 through a switch terminal 258-R of the switching circuit 258 and an amplifier 262. The switch terminals 258-Tr and 258-R are designed to alternate so that when the switch terminal 258-Tr is closed, the switch terminal 258-R is opened, and when the switch terminal-R is closed, the switch terminal 258-Tr is opened. When the switch terminal 258-Tr is closed, the controller 200 operates in radio code signal transmitter mode to transmit the radio demand signal $S_{DM}$. On the other hand, when the terminal 258-R is closed, the controller 200 operates in receiver mode to receive the unique code-indicative signal from the radio code signal transmitter 100.

The demodulator 260 is connected for output to the input terminal $I_1$ of the microprocessor 222.

The switching circuits 246 and 250 are connected to the output terminal $O_3$ of the microprocessor 222. The switching circuits 246 and 250 are operated in tandem to select one pair of antennas 206-D, 210-D or 206-T, 210-T. For instance, the switching circuit 246 connects the antennas 206-D and 210-D to the modulator via the switch terminal 258-Tr of the switching circuit 258 when the door lock operating manual switch 202-D is operated. At the same time, the switching circuit 246 connects the antennas 206-D and 210-D to the demodulator 260 through the switch terminal 258-R and the amplifier 262. Alternatively, when the trunk lid lock operating manual switch 202-T is operated, the switching circuit 246 connects the antennas 206-T and 210-T to the modulator 212 through the switch terminal 258-Tr and the switching circuit 250 connects the antennas 206-T and 210-T to the demodulator 260 via the switch terminal 258-R and the amplifier 262.

The modulator 252 is associated with an oscillator 254 which serves as a carrier-wave generator. The modulator 252 is triggered by the output at the output terminal $O_1$ of the microprocessor 222 to activate the carrier-wave generator 254 which then provides the fixed-frequency carrier wave. The modulator 252 modulates the carrier wave in accordance with the output from the output terminal $O_1$ to generate the radio demand signal $S_{DM}$ and then transmits same through the selected pair of antennas 206-D, 210-D or 206-T, 210-T. The demodulator 260 is designed to separate the carrier wave from the received radio code signal $S_{CD}$ so as to convert the radio signal into a binary signal representative of the unique code stored in the radio code signal transmitter 100. The demodulator 260 applies the encoded binary signal to the input terminal $I_1$ of the microprocessor 222.

The microprocessor 222 is triggered by the input at the input terminal $I_1$ via the demodulator 260 to read a preset code from a preset code memory 264 via a multiplexer 266. The microprocessor 222 compares the unique code with the preset code read from the preset code memory 264 to judge whether the radio code signal transmitter 100 identified by the unique code corresponds to the controller 200 and so is authorized to operate the vehicle devices. The microprocessor 222 outputs a driver signal through one of the output terminals $O_6$, $O_7$ and $O_8$ corresponding to the operated manual switch so as to operate the corresponding vehicle device. i.e. door lock or trunk lid lock, when the unique code matches the preset code.

It would be convenient for the preset code memory 264 to be an external memory connectable to the terminal of the multiplexer 266. In this case, the preset code memory 264 could be stored with the corresponding radio code signal transmitter 100 as a separate unit. The preset code memory 264 and the radio code signal transmitter 100 would be added to the vehicle upon sale so that the separate memory-and-transmitter unit would not be separated from the matching controller. In practice, the preset code memory is programmed by shorting some of a plurality of individual bit cells so as to have a binary output corresponding to the unique code.

The switching circuit 258 is connected to the output terminal $O_2$ of the microprocessor 222 through which a state change-over signal is output. The state change-over signal is indicative of whether the system is transmitting the radio demand signal or receiving the unique code-indicative radio signal from the radio code signal transmitter 100. In practice, the microprocessor 222 keeps the switching circuit 250 in the transmitting state for a given period of time in response to depression of one of the manual switches. Thereafter, the microprocessor 222 then switches the switching circuit 250 to the receiving state. Similarly to the switching circuit 246, the switching circuit 250 is connected to the output terminal $O_3$ of the microprocessor 222 to activate one of the antennas 210-D and 210-T according to which manual switch was depressed.

It should be appreciated that, in the preferred embodiment, the microprocessor 222 normally outputs the state change-over signal through the output terminal $O_2$ to the switching circuit 258 to connect the modulator 252 to the switching circuit 246 in order to hold the controller 200 in transmitter mode. Also, the microprocessor 222 sends an output through the output terminal $O_3$ to select the antennas 206-D and 210-D. In order to periodically transmit the radio demand signal $S_{DM}$ through the antennas 206-D and 210-D, the microprocessor 222 triggers the modulator 252 by the output at the output terminal $O_1$ at regular intervals. This defines the stand-by state of the controller 200 for detecting when the radio code signal transmitter 100 comes into the broadcasting range of the controller, whereupon the door lock is automatically unlocked.

Figure 6:
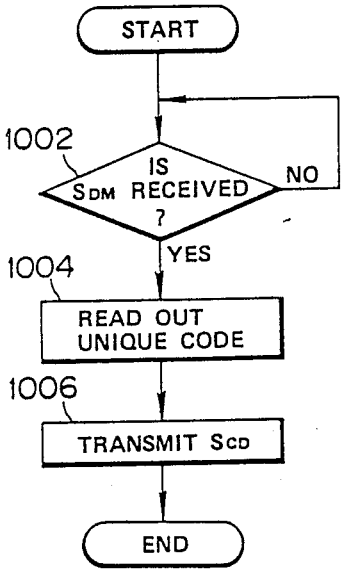
FIG. 6 is a flowchart of a program executed by the microprocessor in the radio code signal transmitter of FIG. 3.

FIG. 6 illustrates the operation of the radio code signal transmitter 100 in the form of a flowchart for a program executed by the microprocessor 114. The microprocessor 114 is triggered to execute the program of FIG. 6, in response to depression of the manual push-button switch 202. An initial block 1002 checks for reception of the radio demand signal SDM. Execution Of the block 1002 loops until the radio demand signal SDM is received through the antenna 102. Upon receipt of the radio demand signal SDM at the block 1004, control passes to a block 1004. In the block 1004, the preset unique code is read from the code memory 124. At a block 1006, a carrier wave produced by a carrier-wave generator 128 is modulated by the unique code signal generator 106 in accordance with the retrieved code to produce the radio code signal. The modulated radio code signal $S_{CD}$ is then transmitted through the antenna 102 to the controller 200 mounted on the vehicle. As set forth above, according to the shown embodiment, the radio code signal transmitter 100 is designed to consume minimal electric power, particularly during stand-by operation at the block 1002. This minimizes the drain on the battery and thus prolongs its life time.

The microprocessor 222 may be provided with a conventional interrupt register 222-2 consisting of flags indicative of occurrence of triggering inputs at each the input terminals $I_4$, $I_{10}$, $I_5$, $I_8$ and $I_9$ in order of priority or occurrence of input. The contents of the register 222-2 are checked in sequence during execution of the main program following the end of each sub-routine. For instance, when the driver's door is closed, the input level at the input terminal $I_4$ goes low the interrupt flag in register 222-2 corresponding to the input terminal $I_4$ is set. This interrupt signalling method is per se well known and can be carried out in various ways. For example, as used in the preferred embodiments, interrupts may be either maskable, i.e. delayable until some other process is completed, or nonmaskable, i.e. triggering immediate execution of an associated routine in preference to all other operations.

Similarly, when the door lock operating manual switch 202 -D is operated, the input level at the input terminal $I_{10}$ changes from high to low. Then, the corresponding flag in the register 222-2 is set to reflect the triggering change in input level at the input terminal $I_{10}$ to signal execution of the second sub-routine. When the driver's door is opened and the door lock is operated to the locking position in preparation to locking the door, the door lock detecting switch 236 closes and the output signal from a series-connected AND gate 272 goes low. When the door lock is manually unlocked, the door lock knob switch 234 closes to change the input level at the input terminal $I_8$ to the low level. When the all of the doors are locked and thus the door lock detecting switch 236 closes, the input level at the input terminal $O_9$ goes low.

Figure 7:
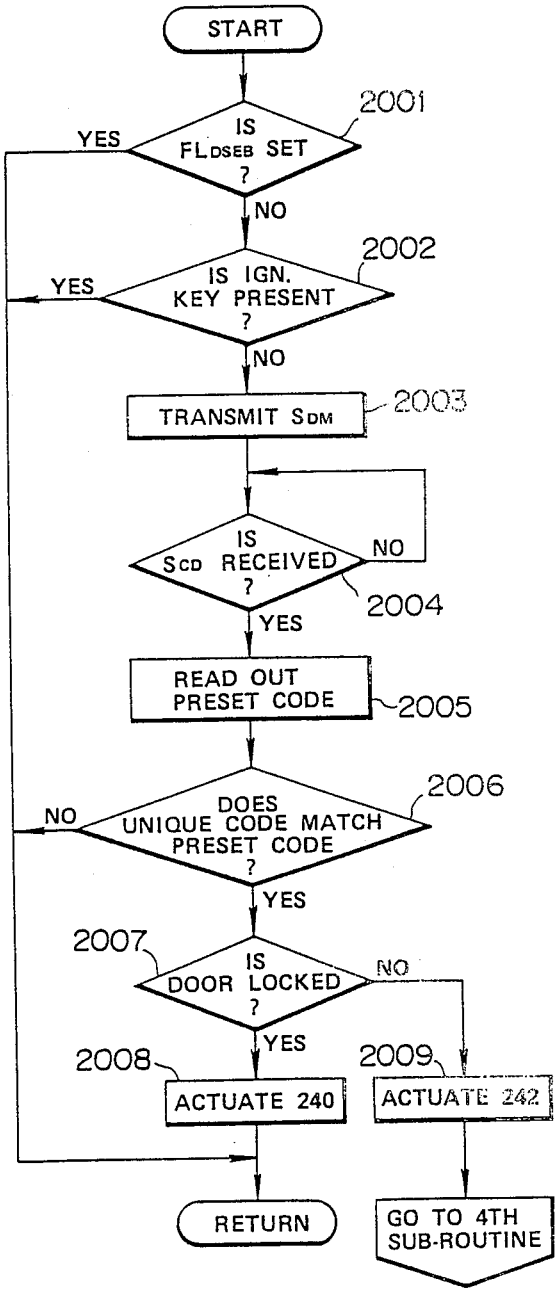
FIG. 7 is a flowchart of a main program to be executed by the microprocessor of the controller of FIGS. 4 and 5.

FIG. 7 is a flowchart of a program to be executed by the controller 200. The controller 200 is triggered to execute the program of FIG. 7 periodically as part of the stand-by state for automatic door locking and unlocking and in response to a low-level input at the input terminal $I_{10}$ caused by operating the door lock manual switch 202-D. At an initial stage of execution of the program of FIG. 7, a disabling flag $FL_{DSEB}$ is checked at a block 2001, which disabling flag is set in a flag register 274 in the CPU when the controller 200 is disabled and is reset as long as the controller is enabled. If the disabling flag $FL_{DSEB}$ is set when checked at the block 2001, the routine of FIG. 18 ends immediately and control returns to the main program.

On the other hand, if the disabling flag $FL_{DSEB}$ is reset when checked at the block 2001, the presence of an ignition key (mechanical key) in the key cylinder (not shown) is checked for at a block 2002. In practice, the presence of the ignition key in the key cylinder is indicated by a high-level input at input terminal $I_7$ connected to the ignition key switch 232. If the input level at the input terminal $I_7$ is high, indicating that the ignition key is in the key cylinder, the user is judged to be in the vehicle. In this case, keyless entry operation is not to be performed and thus, control returns directly to the control program.

In the absence of the ignition key from the key cylinder the demand signal $S_{DM}$ is transmitted at a block 2003 in substantially the same manner as described with respect to the block 2201 of the first sub-routine. As set forth above, the transmission of the demand signal $S_{DM}$ continues for a predetermined period of time. The period for which the controller 200 remains in radio code signal transmitter mode is defined by a timer 276 in the microprocessor 222. After the predetermined period of time expires, the output level at the output terminal $O_2$ changed from low to high in order to open the switch terminal 258-Tr and to close the switch terminal 258-R. As a result, electrical communication between the switching circuit 246 and the modulator is blocked and the switching circuit 248 establishes electrical communication between the demodulator 260 and the latter. This switching procedure for switching the operation mode of the controller 200 may also be used in the foregoing first sub-routine and the subsequent third and sixth routines which will be discussed later.

After switching the operation mode of the controller from the radio code signal transmitter mode to receiver mode, reception of the unique code signal $S_{CD}$ from the radio code signal transmitter is checked for at a block 2004. This block 2004 is repeated until the unique code signal $D_{CD}$ is received.

In practice, the unique code signal $S_{CD}$ is not received within a given waiting period, the keyless entry system would be reset to prevent endless looping. In this case, a theft-preventive counter may be incremented by one and an alarm may be produced when the counter value reaches a given value. This alarm procedure has been disclosed in the aforementioned co-pending U. S. Patent Application filed on the same date. This reception-mode time limit procedure should, in practice, be applied to all routines which await reception of the unique code-indicative signal $S_{CD}$ from radio code signal transmitter 100.

Upon reception of the unique code signal $S_{CD}$ at the block 2004, the preset code is retrieved from the code memory 264 through the multiplexer 266 at a block 2005. The received unique code is compared with the preset code at a block 2006. If the unique code does not match the preset code when compared in the block 2006, then the theft-preventing counter may be incremented by one as set forth above and control returns to the main program. On the other hand, if the unique code matches the preset code, then the input level at the input terminal $I_9$ is checked at a block 2007 to see if the door is locked or unlocked. If the input level at the input terminal $I_9$ is still high, indicating that the door is in locked, the control signal is then fed to the relay 240 to drive the reversible motor 302 -D in the unlocking direction, at a block 2008. After this block 2008, control returns to the main program. On the other hand, when the input level at the input terminal $I_9$ is low when checked at the block 2007, then the relay 242 is energized at a block 2009 to drive the reversible motor 302-D in the locking direction.

Figure 8:
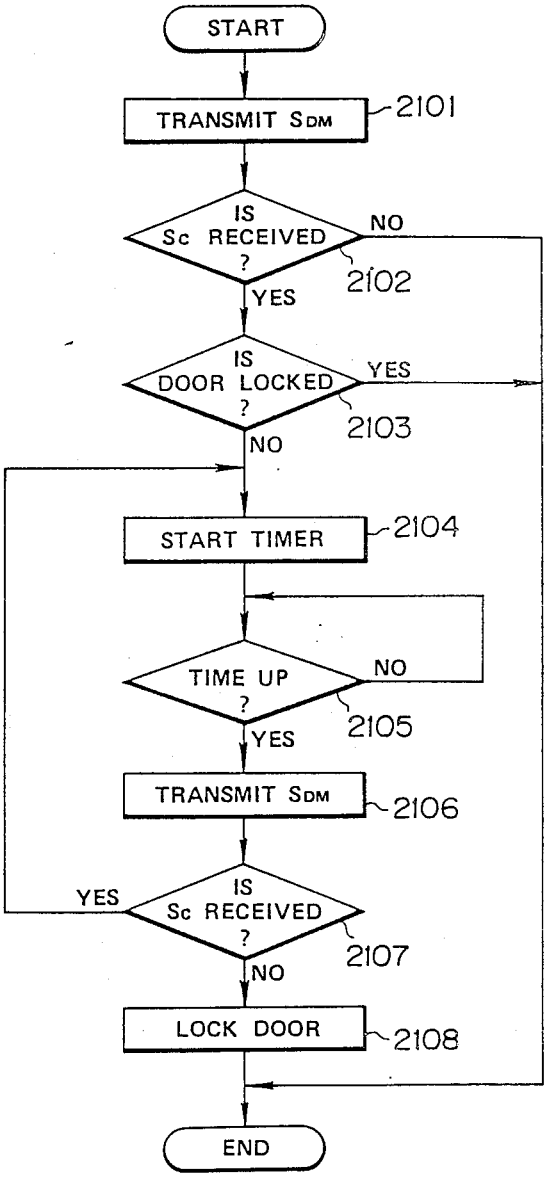
FIG. 8 is a flowchart of an automatic door locking program in the preferred embodiment of the keyless entry system according to the invention.

FIG. 8 shows the preferred embodiment of an automatic door locking program to be executed by the microprocessor 222 of the controller 200. As set forth above, in order to facilitate automatic door locking, the microprocessor 222 of the controller 200 periodically triggers the modulator 252 via the output terminal $O_1$ to transmit the radio demand signal $S_{DM}$ through the antennas 206-D and 210-D. The radio demand signal $S_{DM}$ continues for a given period of time. The microprocessor 222 then checks the input level at the input terminal $I_1$ and performs automatic door locking when the authorized user possessing the radio code signal transmitter 100 leaves the broadcasting range of the controller 200.

The program of FIG. 8 is executed at regular intervals. In each cycle of execution of the program, the output triggering the modulator 252 is output through the output terminal $O_1$ at a step 2101. Then, the input level at the input terminal $I_1$ is checked at the step 2102. If the input level at the input terminal $I_1$ checked at the step 2102 remains LOW for a given period, which indicates the absence of the transmitter 100 in the broadcasting range of the controller 200, the routine ends.

On the other hand, following a HIGH-level input at the input terminal $I_1$ when checked at the step 2102, the input level at the input terminal $I_9$ is checked at a step 2103. If the input level at the input terminal $I_9$ indicates that the door is locked, as detected by the door-lock-detecting switch 236, the routine ends.

On the other hand, if the input level at the input terminal $I_9$ indicates that the door in unlocked, the timer in the controller 200 is activated to start measuring elapsed time at a step 2104. The timer is designed to measure a predetermined period of time sufficient for the authorized user to leave the broadcasting range of the controller. Elapsed time is checked at a step 2105. This time-checking step 2105 is repeated until the aforementioned predetermined period of time expires. Once the time limit is reached at the step 2105, the output triggering the modulator 252 is again produced at the output terminal $O_1$ at a step 2106. Therefore, the radio demand signal $S_{DM}$ is again transmitted through the antennas 206-D and 210-D, at the step 2106. Thereafter the input level at the input terminal $i_1$ is again checked at a step 2107. If the input level at the input terminal $I_1$ remains HIGH when checked at the step 2!07, and thus indicates that the radio code signal transmitter 100 is within the broadcasting range of the controller 200, control returns to the step 2104. In the step 2104, the timer is reset and re-triggered to start measuring elapsed time again.

The steps 2104, 2105, 2106 and 2107 are repeated until the input level at the input terminal $I_1$ goes LOW which indicates the absence of the radio code signal transmitter 100 within the broadcasting range of the controller 200. When a LOW-level input at the input terminal $I_1$ is detected, then the actuator relay 242 is energized to operate the actuator 302-D in the locking direction to lock the door, at a step 2108.

Therefore, the program of FIG. 8 can automatically lock the door upon detecting the absence of the radio code signal transmitter !00 within the broadcasting range. This frees the authorized user of the door-locking operation.

Figure 9:
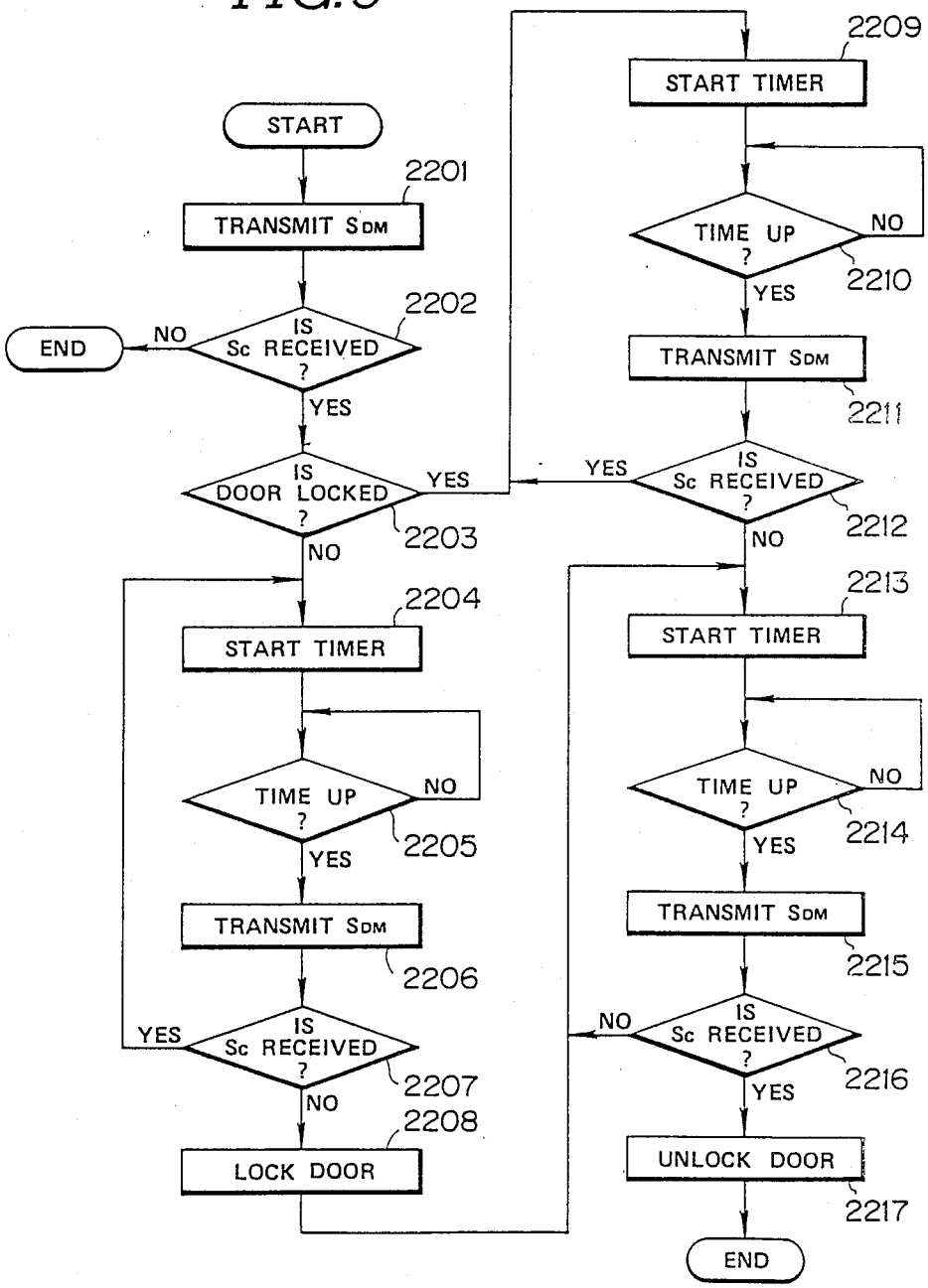
FIG. 9 is a flowchart of another embodiment of an automatic door locking and unlocking program to be performed in the controller of FIG. 5.

FIG. 9 is a modified version of FIG. 8, which facilitates automatic door locking and unlocking according to the absence or presence of the radio code signal transmitter 100 within the broadcasting range of the controller 200.

As in the program of FIG. 8, the program of FIG. 9 is executed at regular intervals. In each cycle of execution of the program, the output triggering the modulator 252 is output through the output terminal $O_1$ at a step 2201. Then, the input level at the input terminal $I_1$ is checked at the step 2202. If the input level at the input terminal $I_1$ when checked at the step 2202 remains LOW for a given period, which indicates the absense of the transmitter 100 in the broadcasting range of the controller 200, the routine ends.

On the other hand, in response to a HIGH-level input at the input terminal $I_1$ when checked at the step 2202, the input level at the input terminal $I_9$ is checked at a step 2203. If the input level at the input terminal $I_9$ indicates that the door is locked, the timer in the controller 200 is activated to start measuring elapsed time at a step 2204. The timer measures a predetermined period of time sufficient for the authorized user to leave the broadcasting range of the controller. Elapsed time is checked at a step 2205. This time-checking step 2205 is repeated until the predetermined period of time expires. Once the time limit is reached at the step 2205. Then, the output triggering the modulator 252 is again produced at the output terminal $O_1$ at a step 2206. Therefore, the radio demand signal $S_{DM}$ is again transmitted through the antennas 206-D and 210-D, at the step 2206. Thereafter the input level at the input terminal $i_1$ is again checked at a step 2207. If the input level at the input terminal $I_1$ remains HIGH when checked at the step 2207, and thus indicates that the radio code signal transmitter 100 is within the broadcasting range of the controller 200, control returns to the step 2204. In step 2204, the timer is reset and re-triggered to start measuring elapsed time again.

The steps 2204, 2205, 2206 and 2207 are repeated until the input level at the input terminal $I_1$ goes LOW which indicates the absense of the radio code signal transmitter 100 within the broadcasting range of the controller 200. If a LOW-level input at the input terminal $I_1$ is detected, then the actuator relay 242 is energized to operate the actuator 302-D in the locking direction to lock the door at a step 2208.

After locking the door at the satep 2208, control passes to a step 2213. The timer in the controller 200 is again activated to measure elapsed time at a step 2213. The timer is designed to measure a predetermined period of time sufficient for the authorized user to leave the broadcasting range of the controller. Elapsed time is checked at a step 2214. This time-checking step 2214 is repeated until the aforementioned predetermined period of time expires. Once the time limit is reached at the step 2214 the output triggering the modulator 252 is again produced at the output terminal $O_1$ at a step 2215. Therefore, the radio demand signal $S_{DM}$ is again transmitted through the antennas 206-D and 210-D, at the step 2215. Thereafter the input level at the input terminal $i_1$ is again checked at a step 2216. If the input level at the input terminal $I_1$ remains LOW when checked at the step 2216, and thus indicates that the radio code signal transmitter 100 is within the broadcasting range of the controller 200, control returns to the step 2213. In the step 2213, the timer is reset and re-triggered to start measuring elapsed time again.

The steps 2213, 2214, 2215 and 2216 are repeated until the input level at the input terminal $I_1$ goes HIGH which indicates the presence of the radio code signal transmitter 100 within the broadcasting range of the controller 200. If a HIGH-level input at the input terminal $I_1$ is detected, then the actuator relay 240 is energized to operate the actuator 302-D in the unlocking direction to unlock the door at a step 2217.

On the other hand, if the input level at the input terminal $I_9$ indicates that the door is locked when checked at the step 2203, then control passes to a step 2209. In the step 2209, the timer in the controller 200 is activated to measure elapsed time at a step 2209. Elapsed time is checked at a step 2210. This time-checking step 2210 is repeated until the predetermined period of time expires. Once the time limit is reached at the step 2210 the output triggering the modulator 252 is again produced at the output terminal $O_1$ at a step 2211. Therefore, the radio demand signal $S_{DM}$ is again transmitted through the antennas 206-D and 210-D, at the step 2211. Thereafter the input level at the input terminal $i_1$ is again checked at a step 2212. If the input level at the input terminal $I_1$ remains LOW when checked at the step 2212, control passes to the Step 2213. On the other hand, if the input level at the input terminal Ii remains HIGH, control returns to the step 2209 to repeat the steps 2209, 2210, 2211 and 2212.

As will be appreciated herefrom, the program of FIG. 9 fully automatically locks and unlocks the vehicle door.

Therefore, the invention fulfills all the objects and advantages sought therefor.

Figure 10:
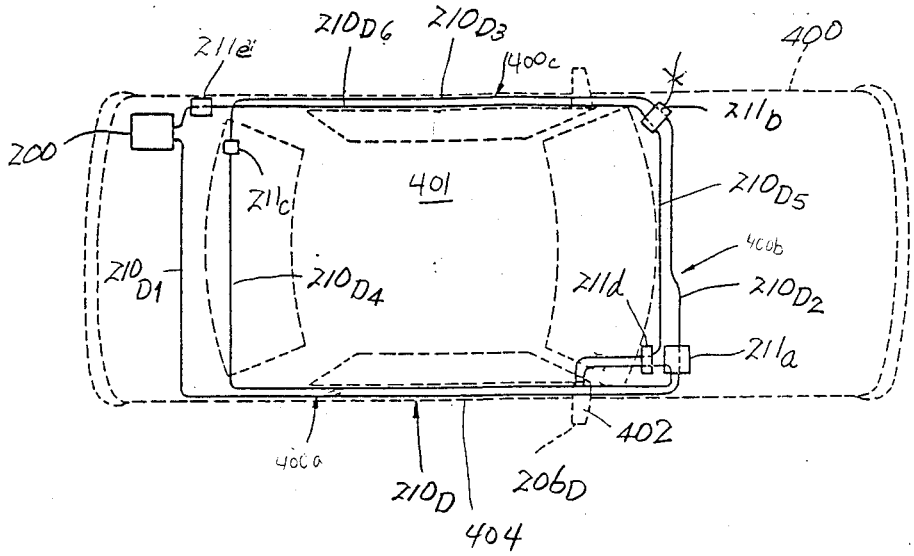
FIG. 10 is a plan view of the vehicle of FIG. 1, showing how to loop antennae are wired with respect to the vehicle compartment.

FIG. 10 shows the preferred embodiment of an antenna device employed in the keyless entry system set forth above. The antenna device comprises a first loop antenna 206D and a second loop antenna 210D. The first antenna 206D is disposed near the vehicular side door **400*a* opposite the driver's seat. (In FIG. 10, the driver's seat is on the right side of the vehicle. Accordingly, the first loop antenna 206D** is disposed near the right side door. However, it would be possible to install first antennas on both sides of the vehicle.)

In the shown embodiment, the first loop antenna 206D is housed within a door mirror housing 402. The loop of the first antenna 206D lies in a plane parallel to the reflective surface of the door mirror.

The second loop antenna 210D is connected to the other pair of antenna terminals of the controller 200. The second loop antenna 210D encircles the vehicle compartment 401. The second loop antenna 210D has a first section $210_{D1}$ which is connected to one of the antenna terminals and which extends through a right-side body harness 406. The first section $210_{D1}$ is connected to a first connector **211*a* disposed near the front end of the vehicle compartment 401. The first section 211*a* of the second loop antenna 210D is connected to a second section $210_{D2}$ of the second loop antenna through the first connector 211*a*. The second section $210_{D2}$ extends through a main harness 400*b* which extends laterally along the front end of the vehicle compartment. The second section $210_{D2}$ is connected to a second connector 221*b*. The second connector 211*b* connects the second section $210_{D2}$ to a third section $210_{D3}$. The third section $210_{D3}$ extends through a left-side body harness 211*c* which extends logitudinally along the left side of the vehicle body. The third section $210_{D3}$ is connected to a third connector $210_{D3}$. The third connector 211*c* connects the third section $210_{D3}$ of the second loop antenna 210D to a fourth section $210_{D4}$. The fourth section $210_{D4}$ extends generally parallel to the first section $210_{D1}$ through the right-side body harness 406. The fourth section $210_{D4}$ is connected to the first connector 211*a* and to a fourth connector 211*d*. The fourth connector 211*d* connects the fourth section $210_{D4}$ to one end of the first loop antenna 206D. The other end of the first loop antenna 206D is connected to a fifth section $210_{D5}$ through the fourth connector 211*d*. The fifth section $210_{D5}$ extends through the main harness 400*b* parallel to the second section $210_{D2}$. The fifth section $210_{D5}$ is connected to a sixth section $210_{D6}$ through the second connector 211*b*. The sixth section $210_{D6}$ extends through the left-side body harness 211*c* and is connected to the other antenna terminal of the controller 200 through a fifth connector 206D1**.

The first, second, third and fourth sections $210_{D1}$, $210_{D2}$, $210_{D3}$ and $210_{D4}$ constitute a first antenna assembly and the first loop antenna 206D and the fifth and sixth sections $210_{D5}$ and $210_{D6}$ constitute a second antenna assembly.

Figure 11:
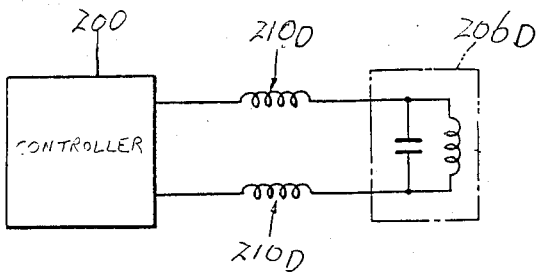
FIG. 11 is a schematic circuit diagram showing the connections between a controller and the loop antennae of FIG. 10.

FIG. 11 shows the equivalent circuit of the aforementioned arrangement of the antenna device according to the invention. As will be appreciated herefrom, the first loop antenna 206D housed within the door mirror housing 402 is connected to the second loop antenna 210D in series.

Figure 12:
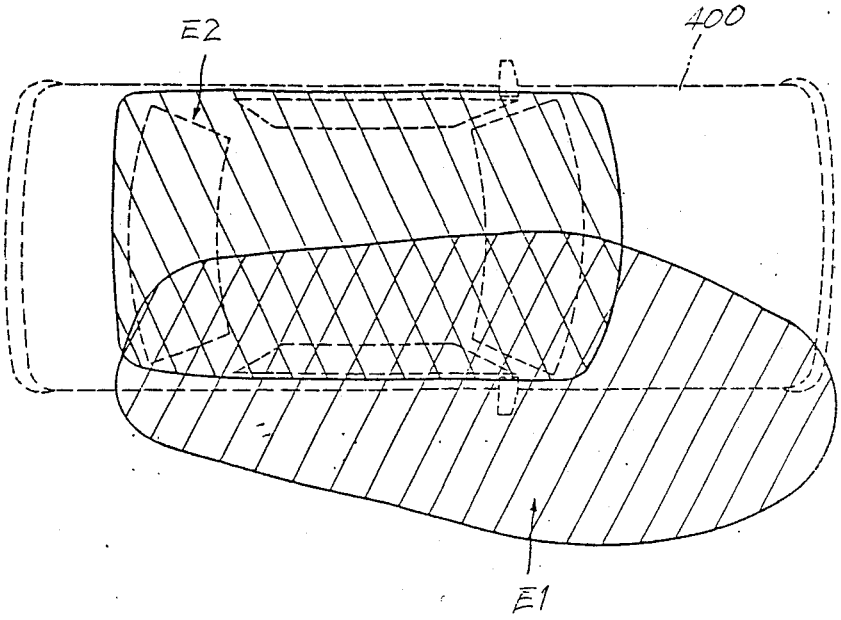
FIG. 12 is a diagram of radio signal transmission ranges around the vehicle of FIG. 1, according to the preferred embodiment of an antenna device according to the invention.

In this arrangement, a radio signal transmission area $E_1$ is formed around the first loop antenna 206D. Also, the second antenna 210D covers its own radio signal transmission area $E_2$. As can be seen in FIG. 12, the radio signal transmission area $E_2$ covers the entire vehicle compartment. Therefore, if the transmitter is placed within the vehicle compartment, radio communication between the transmitter $206_{D4}$ and the controller 200 can be established regardless of the position of the transmitter within the vehicle compartment. Therefore, the presence of the transmitter in the vehicle can be detected to ensure theft-prevention.

Figure 13:
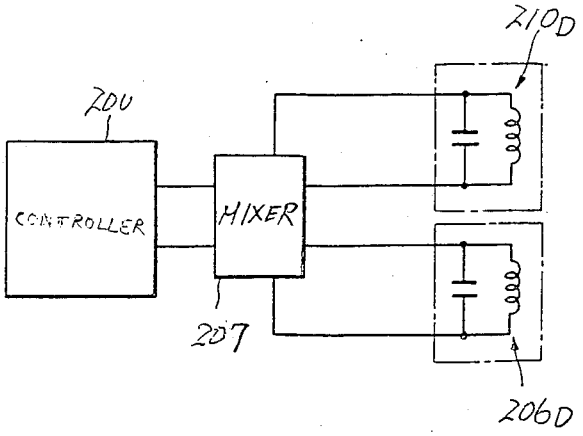
FIG. 13 is a schematic circuit diagram of a modification to the connections between the antenna device and the controller.

Therefore, the present invention fulfills all of the objects and advantages sought therefor. Those skilled in the art will recognize that the shown embodiments can be modified in various ways without departing from the principles of the invention, which are set out in the appended claims. For example, FIG. 13 shows the equivalent circuit of one possible modification. In this case, the two loop antennae 206D and 210D are connected in parallel to each other and their outputs are combined by a mixer 207 interposed between the antennae 206D, 210D and the controller 7.

What is claimed is:

1. An antenna device for an automotive keyless entry system comprising:

a lock device mounted on a vehicle and operable between a first locking position and a second unlocking position, and said lock device including an actuator operating said lock device between said first and second positions in response to a control signal;

a pocket-portable transmitter producing a radio signal containing a unique code identifying the transmitter, said transmitter having a first loop antenna;

a controller receiving said radio signal and comparing said unique code contained in said radio signal with a preset code therein, and producing said control signal when said unique code matches said preset code said controller operatively connected to provide said control signal to said actuator;

a second antenna connected to said controller and surrounding a vehicle compartment.

2. An antenna device as set forth in claim 1, wherein said second antenna comprises a first loop section encircling said vehicle compartment and a second loop section lying in a plane substantially perpendicular to the plane of the first loop section.

3. An antenna device as set forth in claim 2, wherein said first loop section passes through a body harness of a vehicular electrical wiring system.

4. An antenna device as set forth in claim 3, wherein said first loop section extends through a main harness of a vehicular wiring system.

5. An antenna device as set forth in claim 4, wherein said second loop section is housed within a door mirror housing.

6. An antenna device as set forth in claim 5, wherein said second loop section is connected to said first loop section in series.

7. An antenna device as set forth in claim 5, wherein said first and second loop sections are connected to said controller in parallel to each other.

8. An antenna keyless entry system for operating a vehicular door lock device between a first locking position and a second unlocking position, comprising:

an actuator operating said lock device between said first and second positions in response to a control signal;

a pocket-portable transmitter producing a radio signal containing a unique code identifying the transmitter, said transmitter having a first loop antenna;

a controller receiving said radio signal and comparing said unique code contained in said radio signal with a preset code therein, and producing said control signal when said unique code matches said preset code;

second antenna connected to said controller and surrounding a vehicle compartment; and means for detecting keyless operation of said keyless entry system which operates said door lock to said first locking position and alarm means attached to the vehicle, repeatedly triggering said transmitter, for detecting when said transmitter is locked in the vehicle by detecting said radio signal from said transmitter, and in such cases for producing an alarm.

9. An automotive keyless entry system as set forth in claim 8, wherein said alarm means is incorporated in said controller and is operative for producing said alarm when said radio signal continues for a predetermined period of time after keyless operation of said door lock device to said first locking position.

10. An antenna device as set forth in claim 8, wherein said second antenna comprises a first loop section encircling said vehicle compartment and a second loop section lying in a plane substantially perpendicular to the plane of the first loop section.

11. An antenna device as set forth in claim 10, wherein said first loop section passes through a body harness of a vehicular electrical wiring system.

12. An antenna device as set forth in claim 11, wherein said first loop section extends through a main harness of a vehicular wiring system.

13. An antenna device as set forth in claim 12, wherein said second loop section is housed within a door mirror housing.

14. An antenna device as set forth in claim 13, wherein said second loop section is connected to said first loop section in series.

15. An antenna device as set forth in claim 13, wherein said first and second loop sections are connected to said controller in parallel to each other.

* * * * *